US009061256B2

(12) United States Patent
Mori

(10) Patent No.: US 9,061,256 B2
(45) Date of Patent: Jun. 23, 2015

(54) MICRO-BUBBLE GENERATOR

(75) Inventor: Yoshimichi Mori, Osaka (JP)

(73) Assignee: MORI TEKKO CO., LTD, Osaka (JP)

( * ) Notice: Subject to any disclaimer, the term of this patent is extended or adjusted under 35 U.S.C. 154(b) by 300 days.

(21) Appl. No.: 13/347,494

(22) Filed: Jan. 10, 2012

(65) Prior Publication Data

US 2013/0214436 A1 Aug. 22, 2013

(30) Foreign Application Priority Data

Jun. 14, 2011 (JP) ..... 2011-3319 U

(51) Int. Cl.

| | |
|---|---|
| ***B01F 3/04*** | (2006.01) |
| ***B01F 5/04*** | (2006.01) |
| ***B05B 7/04*** | (2006.01) |
| ***B05B 7/12*** | (2006.01) |
| *B05B 1/18* | (2006.01) |
| *E03C 1/084* | (2006.01) |

(52) U.S. Cl.

CPC ..... *B01F 3/04113* (2013.01); *B01F 5/0428* (2013.01); *B05B 1/18* (2013.01); *B01F 3/04503* (2013.01); *B01F 2003/04858* (2013.01); *B01F 2215/0431* (2013.01); *B05B 7/0425* (2013.01); *B05B 7/12* (2013.01); *E03C 1/084* (2013.01)

(58) Field of Classification Search

CPC ..... B01F 3/04503; B01F 3/04113; B01F 5/0428; B01F 2003/04858; B01F 2215/0431; B05B 1/18; B05B 7/0425; B05B 7/12; E03C 1/084

USPC ..... 261/76, DIG. 75

See application file for complete search history.

(56) References Cited

U.S. PATENT DOCUMENTS

| | | | | | |
|---|---|---|---|---|---|
| 1,351,624 | A * | 8/1920 | Cox | 261/45 |
| 1,491,057 | A * | 4/1924 | Myers | 417/174 |
| 3,451,409 | A * | 6/1969 | Roche | 137/807 |
| 3,640,516 | A * | 2/1972 | Willinger | 261/121.2 |
| 4,927,568 | A * | 5/1990 | Campau | 261/36.1 |
| 5,073,310 | A * | 12/1991 | Ramsey | 261/76 |
| 5,350,543 | A * | 9/1994 | Spradley | 261/36.1 |
| 5,756,012 | A * | 5/1998 | McGlashan et al. | 261/27 |
| 6,601,832 | B1 * | 8/2003 | Palmu | 261/64.3 |
| 2004/0251566 | A1 * | 12/2004 | Kozyuk | 261/76 |
| 2008/0048348 | A1 * | 2/2008 | Kung | 261/76 |

* cited by examiner

*Primary Examiner* — Charles Bushey
(74) *Attorney, Agent, or Firm* — Barceló, Harrison & Walker, LLP

(57) ABSTRACT

A microbubble generator is described, that enables inexpensive manufacturing cost and miniaturization to generate micro bubbles in certain embodiments, without adopting the complicated prior art venturi tube structure. One embodiment has a water supply side joint on one end of a main tube which is formed as a cylinder and a water drain side joint on the other. The supply side joint and the drain side joint are connected with a water channel that runs along the axis of the tube, and in the middle of said channel there is a narrower, restricted channel whose internal diameter is 6 millimeters or less. A water supply side channel is constituted between the supply side joint and the restricted channel, and a water drain side channel is constituted between the restricted channel and the drain side joint.

1 Claim, 3 Drawing Sheets

MICRO-BUBBLE GENERATOR

CROSS-REFERENCE TO RELATED APPLICATIONS

This application claims to Japanese Utility Model Application No U2011-3319 (Reg. No. 3169936), filed on Jun. 14, 2011. The entire contents of said application are incorporated herein by reference.

BACKGROUND OF THE DISCLOSURE

1. Field of the Invention

The present invention relates to a microbubble generator.

2. Description of the Related Art

It is known that, when washing various items and showering pets, using water mixed with an innumerable number of microbubbles with a size of 10 to 50 micrometers is highly effective in removing dirt and grime. In recent years, the same effect has also been confirmed with showers for human use. Previously, as a microbubble generator for generating microbubbles, a shower head containing a Venturi tube in its base portion has been proposed (for example, see Japanese patent document JP-A-2006-116518).

As is well known, a Venturi tube has in its middle a narrow restriction or throat, and on the water supply side (upstream side) of the throat there is a narrowing tapered section whose diameter narrows gradually as it approaches the throat, and on the water drain side (downstream side) of the throat there is a widening tapered section whose diameter widens gradually as it moves away from the throat. In a Venturi tube, water flowing through the throat accelerates and decompresses. Therefore, if one adds a structure that can bring outside air in and towards the throat, small air bubbles may be incorporated into the water flow inside the throat, thus enabling the generation of microbubbles on the downstream side of the throat.

Also, it has been proposed to install a rotary blade for generating a swirl flow on the water drain side of a Venturi tube in order to intensify and stabilize the acceleration and decompression of the water flow in the throat (for example, see Japanese patent document JP-A-2007-21343).

As noted above, previously known microbubble generators employed a Venturi tube as their main component. One reason for adopting the Venturi tube method is that, by incorporating a narrowing tapered section and a widening tapered section, one can expect to maintain the water in the throat in a laminar flow state as much as possible, prevent turbulence, reduce tube resistance, and thereby accelerate the water flow and generate the decompression effect in an efficient manner.

However, manufacture of Venturi tubes requires special, dedicated tools specifically designed for the respective taper angles of the narrowing and widening tapered sections (such as a tapered end mill or a tapered reamer) or processing machinery (such as a circular saw), which pushes up the cost of manufacturing microbubble generators. Needless to say, when a rotary blade is added, processing of the rotary blade itself is relatively difficult, and it will push up the manufacturing cost even further.

Also, with the Venturi tube method, the existence of the narrowing and widening tapered sections makes the apparatus long in the direction of the tube's axis, which naturally makes the microbubble generator as a whole long, which in turn leads to various problems such as difficulty in handling, a large size in its mounted state, and limitation of mounting locations.

The present invention was developed in consideration of the foregoing, and in certain embodiments aims to solve the existing problems and produce microbubble generators that can be manufactured more cheaply and made smaller, by adopting a configuration that can generate microbubbles without relying on the Venturi tube method which requires complicated structures.

Thus, it is desirable to address the limitations in the art.

SUMMARY

A microbubble generator based on embodiments of the present invention has the following characteristics: It has a water supply side joint on one end of the main tube which is formed as a cylinder and a water drain side joint on the other. The supply side joint and the drain side joint are connected with a water channel that runs along the axis of the tube, and in the middle of said channel there is a narrower, restricted channel whose internal diameter is 6 millimeters or less. A water supply side channel is constituted between the supply side joint and the restricted channel, and a water drain side channel is constituted between the restricted channel and the drain side joint, and both the supply side channel and the drain side channel have a larger diameter than that of the restricted channel and are formed as non-tapered, straight holes along the axis.

The restricted channel in certain embodiments has a side hole which opens along the radial of the main tube to outside of the tube, and the side hole is equipped with an adjustment area which has a female thread on its internal surface. An air intake adjuster equipped with a male thread that conforms with the female thread of the adjustment area is screwed into the side hole in a way that allows it to be rotated. In certain embodiments, the screw clearance created between the female and male threads in said adjustment area can be adjusted by rotating the air intake adjuster.

In certain embodiments, the water drain side channel has a smaller diameter than said water supply side channel.

The water supply side channel in certain embodiments has a supply side bevel which decreases the internal diameter of the supply side channel as it approaches the restricted channel with the same angle as the included angle of the drilling tool used to make the supply side channel, and said water drain side channel has a drain side bevel which decreases the internal diameter of the drain side channel as it approaches the restricted channel with the same angle as the included angle of the drilling tool used to make the drain side channel.

Other aspects and advantages of various aspects and embodiments of the present invention can be seen upon review of the figures, the detailed description, and the claims that follow.

BRIEF DESCRIPTION OF THE DRAWINGS

By way of example, reference will now be made to the accompanying drawings, which are not to scale.

DETAILED DESCRIPTION

Those of ordinary skill in the art will realize that the following description of the present invention is illustrative only and not in any way limiting. Other embodiments of the invention will readily suggest themselves to such skilled persons, having the benefit of this disclosure. Reference will now be made in detail to specific implementations of the present invention as illustrated in the accompanying drawings. The same reference numbers will be used throughout the drawings and the following description to refer to the same or like parts.

Embodiments of the present invention are described below based on FIGS. 1 through 3.

Figure 2:
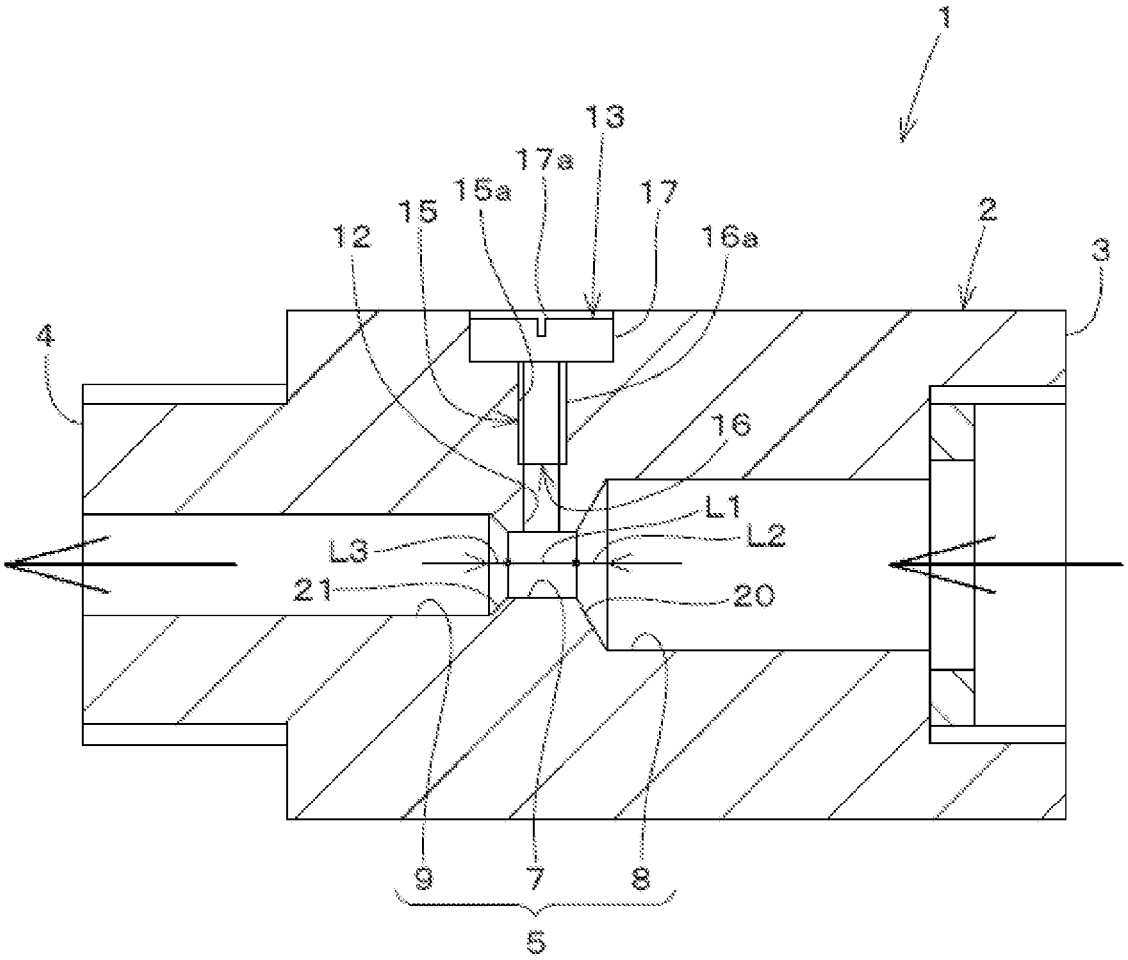
FIG. 2 is a sectional side elevation showing a microbubble generator according to aspects of the present invention.

As shown in the Figures, microbubble generator (1) consists of a main (2) tube which is formed as a cylinder equipped with a water supply side joint (3) on its one end (the right hand side of FIG. 2) and a water drain side joint (4) on the other end (the left hand side of FIG. 2).

In this embodiment, the water supply side joint (3) constitutes a female thread end and the water drain side joint (4) constitutes a mail thread end. However, the embodiment is not limited to this particular configuration. The water supply side joint (3) can be the male thread end and the water drain side joint (4) the female thread end, or, both joint ends (3, 4) can be female or male thread ends.

Inside the main tube (2) is a water channel (5) which connects the water supply side joint (3) and the water drain side joint (4) and runs along the axis of the tube. Approximately in the middle of this water channel (5) is a restricted channel (7) with a smaller diameter. Since the water channel (5) has the restricted channel (7) in its middle, it can be said that a water supply side channel (8) is formed between the water supply side joint (3) and the restricted channel (7), and a water drain side channel (9) is formed between the water drain side joint (4) and the restricted channel (7). In other words, the water channel (5) is formed by the interconnection of the water supply side channel (8), the restricted channel (7), and the water drain side channel (9), listed in the order of the water flow, from the upstream side to the downstream side.

Also, the restricted channel (7) has a side hole (12) which opens along the radial of the main tube (2) to outside of the tube, and an air intake adjuster (13) is screwed into this side hole (12).

An adjustment area (15) with a female thread (15*a*) is formed on the inner surface of the side hole (12). This adjustment area (15) (i.e. the area where the female thread (15*a*) is present) can cover the entire length of the side hole (12).

In this embodiment, there is a non-tapered, straight hole area inside the side hole (12) near the restricted channel (7) where an adjustment area (15) is not formed. This structure has an advantage in that it makes it easier to cut the female thread (15*a*) inside the side hole (12). Also, a counter-sunk hole (a recess) is formed in the side hole (12) near the external surface of the main tube (2) in order to prevent the air intake adjuster (13) from sticking out.

The air intake adjuster (13) has a valve shaft (16) to be inserted into the adjustment area (15) of the side hole (12) and an adjustment head (17) at the end of the valve shaft (16) that faces toward outside of the tube. On the surface of the valve shaft (16), a male thread (16*a*) that conforms with the female thread (15*a*) in the adjustment area (15) is formed. Also, preferably, the adjustment head (17) should be a disc with a larger diameter than that of the valve shaft (16) and should have a tool engaging feature (17*a*) on its top surface that accepts a screw driver (not shown in the figures) or another tool. This adjustment head (17) is designed to be entirely or partially contained in the counter-sunk hole provided in the side hole (12).

These features make it possible in certain embodiments to insert the air intake adjuster (13) into the side hole (12) from its valve shaft (16) end and rotate it, thereby engaging the male thread (16*a*) formed on the valve shaft (16) with the female thread (15*a*) formed on the adjustment area (15). Therefore, by rotating the air intake adjuster (13), one can engage the male thread (16*a*) further into the female thread (15*a*).

When the adjustment head (17) touches the open end of the side hole (12) (the bottom of the counter-sunk hole), the length of engagement of the male thread (16*a*) with the female thread (15*a*) reaches its maximum, and it cannot be screwed in any further. At this time, the female thread (15*a*) and the male thread (16*a*) come into close contact with one another, and in the adjustment area (15) of the side hole (12), the screw clearance (a very small gap that allows the movement of the male thread (16*a*) against the female thread (15*a*)) becomes zero, thereby shutting off the air flow. The fact that the adjustment head (17) is touching the open end of the side hole (12) (the bottom of the counter-sunk hole) also contributes to the blocking of air flow.

On the other hand, when the air intake adjuster (13) is rotated in a direction that loosens it, the close contact between the female thread (15*a*) and male thread (16*a*) is broken. This creates a screw clearance in the adjustment area (15) in the side hole (12), thereby allowing air to flow through the adjustment area (15).

Furthermore, the length along the axis of the engagement between the female thread (15*a*) and the male thread (16*a*) in the adjustment area (15) (the amount of the screw clearance) and the rate of air flow allowed by the screw clearance are inversely proportional to one another. Therefore, air-intake can be finely adjusted by rotating the air intake adjuster (13).

In certain embodiments, the internal diameter of the restricted channel (7) should be 6 millimeters or less, and preferably 5 millimeters or less (in one embodiment it is 4 millimeters). If it is over 6 millimeters, the water flow may not be accelerated and decompressed sufficiently, and generation of microbubbles may become unstable or impossible. On the other hand, if the internal diameter of the restricted channel (7) is less than 3 millimeters, pipe resistance against the water flow becomes too strong and the drained water becomes less aqueous, which may be a problem. Therefore, the internal diameter of the restricted channel (7) should be between 3 and 6 (5) millimeters.

Also, while the length of the restricted channel (7) along its axis (L1) should be short, it should be long enough so that the side hole (12) can be formed. For example, if the internal diameter of the side hole (12) (female thread's (15*a*) nominal diameter) is 3 millimeters, L should be around 4 millimeters.

Compared to the restricted channel (7) with aforementioned characteristics, both the water supply side channel (8) and the water drain side channel (9) may be made to have a larger diameter than that of the restricted channel (7). Also, the diameter of the water drain side channel (9) may be made to be smaller than that of the water supply side channel (8). In this embodiment, the internal diameter of the water supply side channel (8) is 10 millimeters and the internal diameter of the water drain side channel (9) is 6 millimeters.

The water supply side channel (8) and the water drain side channel (9) in certain embodiments can be formed by using a drilling tool to create a hole in the main tube (2) beginning from its end. In this instance, both the water supply side channel (8) and the water drain side channel (9) are formed as non-tapered, straight holes whose internal diameter remains constant along the tube's axis. Also, at the part where the water supply side channel (8) connects to the restricted channel (7), the drilling tool's included angle (for example 118 degrees) forms a supply side bevel (20) that decreases the internal diameter of the water supply side channel (8) as it approaches the restricted channel (7). Similarly, at the part where the water drain side channel (9) connects to the restricted channel (7), the drilling tool's included angle forms a drain side bevel (21) that decreases the internal diameter of the water drain side channel (8) as it approaches the restricted channel (7).

Based on the relationship between the internal diameters of the water supply side channel (8) and water drain side channel (9) and the internal diameter of the restricted channel (7), the length of the supply side bevel (20) along the axis (L2) should be around 2 millimeters, and the length of the drain side bevel (21) along the axis (L3) should be around 1 millimeter. The supply side bevel (20) and the drain side bevel (21), having the length of L2 an L3, respectively, are expected to regulate the flow of water that goes in and out of the restricted channel (7) (equivalent to the reduction of turbulence performed by the narrowing and widening tapered sections of a Venturi tube).

Figure 3:
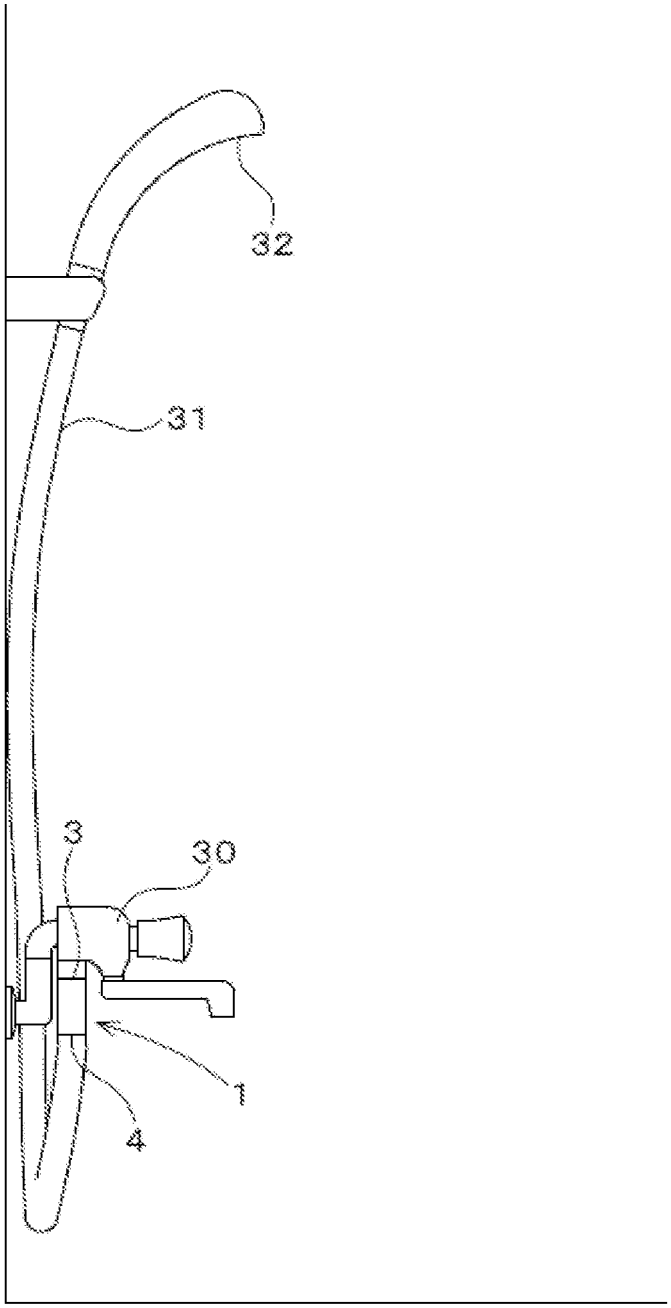
FIG. 3 is a side view showing the operating condition of a microbubble generator according to aspects of the present invention.

A microbubble generator (1) constituted in this manner can be used, as shown in FIG. 3 as an example, in between a water faucet (30) and a shower hose (31) by connecting the water supply side joint (3) to the water faucet (30) and connecting the water drain side joint (4) to the shower hose (31).

Figure 1:
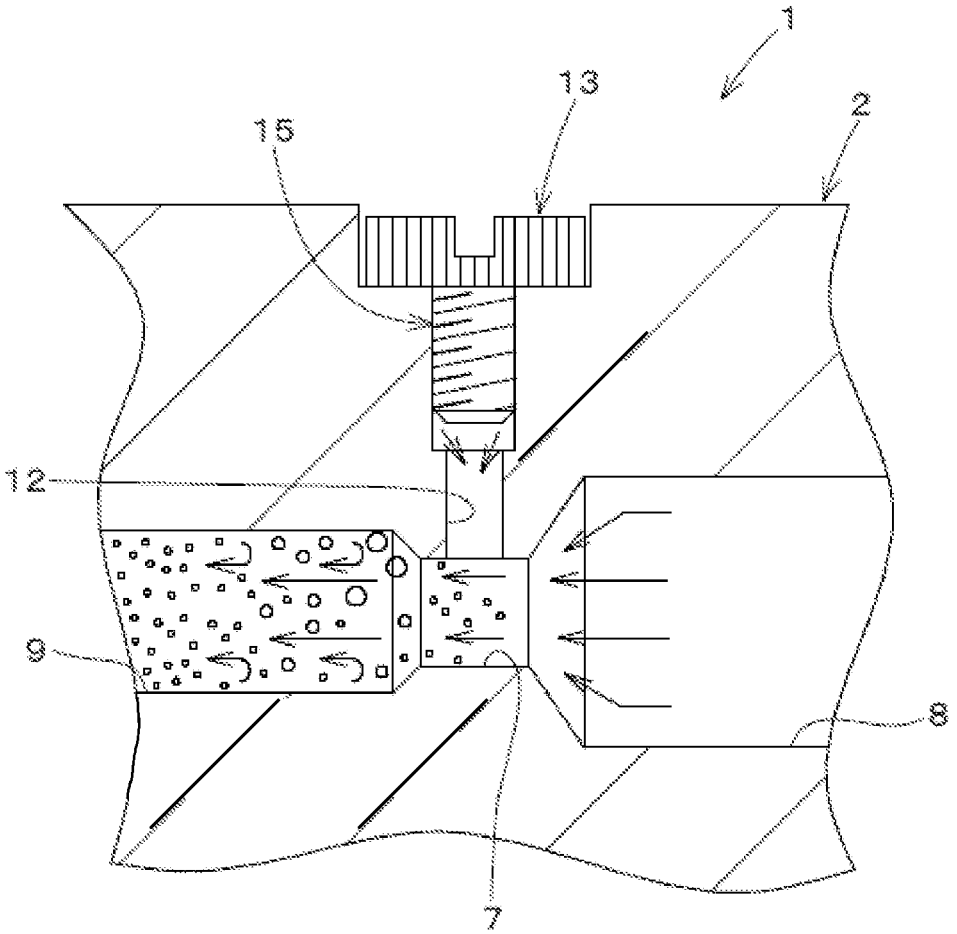
FIG. 1 is a sectional side elevation explaining the mechanism of microbubble generation by a microbubble generator according to aspects of the present invention.

When the water faucet (30) is opened to supply water into the shower, as shown in FIG. 1, water that flows from the water supply side channel (8) into the restricted channel (7) may become accelerated and decompressed inside the restricted channel (7). Because of this decompression in the restricted channel (7), outside air will be sucked into the restricted channel (7) through the very small screw clearance formed in the adjustment area (15) of the side hole (12).

The amount of air that is sucked into the restricted channel (7) is restricted depending on the screw clearance in the adjustment area (15), and microbubbles are generated when this air is absorbed into water in the restricted channel (7).

When the water containing microbubbles flows out of the restricted channel (7) into the water drain side channel (9), the water flow collides against the water that already exists in the water drain side channel (9) and microbubbles contained in the water flow are further fragmented. The effect of this fragmentation of microbubbles in the water drain side channel (9) can be further enhanced by making the internal diameter of the water drain side channel (9) smaller than that of the water supply side channel (8).

After this manner, water containing an abundance of microbubbles (that are especially small among what are generally referred to as microbubbles) is agitated in the shower hose (31) and then spouts out of the shower head (32).

The diameter and the amount of microbubbles in the water can be adjusted by manipulating (rotating) the air intake adjuster (13) installed in the side hole (12).

Even when the water pressure of the tap water varies in different areas or depending on the building and the existence or lack of a water storage tank, generation of microbubbles can be adjusted by manipulating the air intake adjuster (13). Furthermore, even when the air intake adjuster (13) is manipulated so that the adjustment area (15) in the side hole (12) is completely closed, as long as the water pressure is sufficient, microbubbles can still be generated through cavitations that occur in the restricted channel (7).

The present invention is not limited to the embodiment described above, and can be modified into different embodiments. For example, a microbubble generator based on the present invention (1) does not have to be used in between a water faucet (30) and a shower hose (31). Instead, it can be placed between a shower hose (31) and a shower head (32). Of course, it can also be used for showers for pets and various washing machines.

A microbubble generator based on embodiments of the present invention (1) can be used to supply or circulate water in tanks for cultivating fish, shellfish, seaweed and algae, or for growing aquarium fish. Compared with a situation where it is not used, the microbubble generator (1) used in this manner can have drastic effects in promoting growth.

The water drain side channel (9) can be formed with a diameter that is equal to or larger than that of the water supply side channel (8).

The supply side bevel (20) and drain side bevel (21) can be omitted. Instead, it is acceptable to have a step that is vertical in relation to the axis at the part where the water supply side channel (8) connects to the restricted channel (7) and the part where the water drain side channel (9) connects to the restricted channel (7).

The internal diameter of the restricted channel, the length along the axis of the supply side bevel (20) and drain side bevel (21) (L2, L3), and internal diameter of the water supply side channel (8) and water drain side channel (9) are not limited to specific values.

When the pressure of water coming into the water supply side channel (8) (water pressure at the tap, etc.) is sufficient, the side hole (12) and the air intake adjuster (13) can be omitted.

A microbubble generator according to certain embodiments has the following characteristics: It has a water supply side joint on one end of the main tube which is formed as a cylinder and a water drain side joint on the other. The supply side joint and the drain side joint are connected with a water channel that runs along the axis of the tube, and in the middle of said channel there is a narrower, restricted channel whose internal diameter is 6 millimeters or less. A water supply side channel is constituted between the supply side joint and the restricted channel, and a water drain side channel is constituted between the restricted channel and the drain side joint, and both the supply side channel and the drain side channel have a larger diameter than that of the restricted channel and are formed as non-tapered, straight holes along the axis.

A microbubble generator according to certain embodiments has the foregoing characteristics, and the following additional characteristics: The restricted channel has a side hole which opens along the radial of the main tube to outside of the tube, and the side hole is equipped with an adjustment area which has a female thread on its internal surface. An air intake adjuster equipped with a male thread that conforms with the female thread of the adjustment area is screwed into the side hole in a way that allows it to be rotated, and the screw clearance created between the female and male threads in said adjustment area can be adjusted by rotating the air intake adjuster.

A microbubble generator according to certain embodiments has the foregoing characteristics from the any of the previous two paragraphs, and the following additional characteristics: The water drain side channel is formed with a smaller diameter than that of the water supply side channel.

A microbubble generator according to certain embodiments has the foregoing characteristics from any of the previous three paragraphs, and the following additional characteristics: The water supply side channel has a supply side bevel which decreases the internal diameter of the supply side channel as it approaches the restricted channel with the same angle as the included angle of the drilling tool used to make the supply side channel, and said water drain side channel has a drain side bevel which decreases the internal diameter of the drain side channel as it approaches the restricted channel with the same angle as the included angle of the drilling tool used to make the drain side channel.

While the above description contains many specifics and certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. The invention includes any combination or subcombination of the elements from the different species and/or embodiments disclosed herein. One skilled in the art will recognize that these features, and thus the scope of the present invention, should be interpreted in light of the following claims and any equivalents thereto.

I claim:

1. A microbubble generator comprising:

a water supply side joint on one end of a main tube which is formed as a cylinder and a water drain side joint on the other end;

wherein the supply side joint and the drain side joint are connected with a water channel that runs along the axis of the tube, and in the middle of said channel there is a narrower, restricted channel whose internal diameter is between 3 millimeters and 6 millimeters;

wherein a water supply side channel is constituted between the supply side joint and the restricted channel, and a water drain side channel is constituted between the restricted channel and the drain side joint, and both the supply side channel and the drain side channel have a larger diameter than that of the restricted channel and are formed as non-tapered, straight holes along the axis;

wherein said restricted channel has a side hole which opens along the radial surface of the main tube to outside of the tube, and the side hole is equipped with an adjustment area which has a female thread on its internal surface, and wherein an air intake adjuster equipped with a male thread that conforms with the female thread of the adjustment area is screwed into the side hole in a way that allows it to be rotated, and the screw clearance created between the female and male threads in said adjustment area can be adjusted by rotating the air intake adjuster;

wherein said water drain side channel is formed with a smaller diameter than that of the water supply side channel; and wherein said water supply side channel has a supply side bevel which decreases the internal diameter of the supply side channel as it approaches the restricted channel with the same angle as the included angle of the drilling tool used to make the supply side channel, and said water drain side channel has a drain side bevel which decreases the internal diameter of the drain side channel as it approaches the restricted channel with the same angle as the included angle of the drilling tool used to make the drain side channel.

* * * * *